US006450355B1

(12) United States Patent
Lowry

(10) Patent No.: US 6,450,355 B1
(45) Date of Patent: Sep. 17, 2002

(54) REVERSIBLE OVERCAP FOR ADJUSTABLE VOLUME CONTAINER

(75) Inventor: James W. Lowry, Florence, SC (US)

(73) Assignee: Sonoco Development, Inc., Hartsville, SC (US)

( * ) Notice: Subject to any disclaimer, the term of this patent is extended or adjusted under 35 U.S.C. 154(b) by 0 days.

(21) Appl. No.: 09/562,180

(22) Filed: May 2, 2000

(51) Int. Cl.[7] ..... B65D 3/04; B65D 5/54; B65D 5/355

(52) U.S. Cl. ..... 220/4.26; 220/212; 220/287; 220/796; 229/4.5; 229/93; 229/101.1; 229/101.2; 229/125.06

(58) Field of Search ..... 220/287, 780, 220/796, 801, 212, 4.26, 4.03; 215/319; 229/101, 101.1, 101.2, 124, 125.01, 125.06, 93, 4.5

(56) References Cited

U.S. PATENT DOCUMENTS

| | | | | | |
|---|---|---|---|---|---|
| 893,469 | A | | 7/1908 | Essmuller | |
| 1,961,559 | A | | 6/1934 | Herrmann | |
| 1,979,706 | A | | 11/1934 | Reamy | |
| 2,605,013 | A | * | 7/1952 | Rubenstein | 229/101.2 |
| 2,717,619 | A | | 9/1955 | Whitman | |
| 2,760,672 | A | | 8/1956 | Cronheim | |
| 2,949,369 | A | | 8/1960 | Zoeller et al. | |
| 2,969,902 | A | * | 1/1961 | Cage | 229/4.5 |
| 2,972,407 | A | * | 2/1961 | Taylor | 220/4.26 |
| 3,120,900 | A | | 2/1964 | Faulstich | |
| 3,141,567 | A | | 7/1964 | Schearer | |
| 3,455,500 | A | | 7/1969 | Wilcox | |
| 3,580,481 | A | | 5/1971 | Koboldt | |
| 3,606,074 | A | | 9/1971 | Hayes | |
| 3,624,789 | A | | 11/1971 | Peyser et al. | |
| 3,960,624 | A | | 6/1976 | Erlandson | |
| 4,047,329 | A | | 9/1977 | Holt | |
| 4,061,244 | A | | 12/1977 | Tucker | |
| 4,091,953 | A | | 5/1978 | Daenen | |
| 4,762,233 | A | * | 8/1988 | Sears et al. | 229/101.2 |
| 4,957,039 | A | | 9/1990 | Reyes | |
| 5,169,020 | A | | 12/1992 | Spamer | |
| 5,217,164 | A | * | 6/1993 | Sullivan | 229/101.1 |
| 5,377,859 | A | | 1/1995 | Hacker | |
| 5,392,949 | A | | 2/1995 | McKenna | |
| 5,429,265 | A | | 7/1995 | Maire et al. | |
| 5,497,879 | A | | 3/1996 | Kao | |
| 5,577,539 | A | | 11/1996 | Shaw et al. | |
| 5,586,656 | A | | 12/1996 | Abrums | |
| 5,597,088 | A | | 1/1997 | Fingerie et al. | |
| 5,678,720 | A | | 10/1997 | Van Melle | |
| 5,695,086 | A | | 12/1997 | Viola | |
| 5,850,935 | A | * | 12/1998 | Luburic et al. | 229/101.1 |
| 6,015,061 | A | | 1/2000 | Lowry | |
| 6,142,366 | A | * | 11/2000 | Sagel | 229/101.2 |

FOREIGN PATENT DOCUMENTS

| | | |
|---|---|---|
| DE | 7420970 | 11/1974 |
| FR | 2306136 | 10/1976 |

* cited by examiner

*Primary Examiner*—Lee Young
*Assistant Examiner*—Niki M. Eloshway
(74) *Attorney, Agent, or Firm*—Alston & Bird LLP

(57) ABSTRACT

A reversible overcap for an adjustable volume container for consumer products is provided. A first side of the overcap includes a radially extending surface and an annular rim extending outwardly therefrom for engaging a retaining rim of the adjustable volume container. A second side of the overcap includes an annular member that is adapted to frictionally engage the exposed end of the remaining portions of the container that are formed by separating a portion of the container from the remaining portion of the container. The reversible overcap of the present invention is thus a multi-functional end closure and forms part of a completely self-contained adjustable volume container for consumer products that continuously accommodates the volume of the food product in the container.

6 Claims, 4 Drawing Sheets

REVERSIBLE OVERCAP FOR ADJUSTABLE VOLUME CONTAINER

FIELD OF THE INVENTION

The present invention relates to container overcaps, and more particularly, to overcaps for adjustable volume containers.

BACKGROUND OF THE INVENTION

Multi-ply composite containers are used for packaging a wide variety of food and drink products, as well as other perishable items. Some of these containers, such as containers for potato crisps, are constructed to be opened at either one of two spaced ends that are sealed, either permanently or with a removable seal. To package perishable food products, a container is required that is rigid enough to retain its shape during shipping while tightly sealing the food product to protect against deterioration, leakage and contamination. Thus, these composite containers conventionally include three separate plies or sets of plies and two end closures.

First, at least one structural body ply made of paperboard material is included, which is formed into a tubular structure by wrapping a continuous strip of body ply paperboard material around a shaping mandrel. The body ply is spirally wound around the mandrel or passed through a series of forming elements so as to be wrapped in a convolute shape around the mandrel. These containers also typically include a liquid impermeable liner ply adhered to the inner surface of the paperboard body ply. The liner ply seals the food product within the container, and also prevents liquids, which may possibly contaminate the food product, from entering the container. Some liner plies are also gas impermeable, so as to not only prevent food product odors from escaping the can, but also prevent atmospheric air from entering the container and spoiling the food product. Thus, while the purpose of the body ply is to provide necessary structural properties to the container, the liner ply provides various properties necessary to contain and maintain the perishable food product.

A label ply is also included, and is adhered to the outer surface of the paperboard body ply. The label ply serves two primary functions. First, a composite can label is a source of information. The label carries graphical matter that conveys product information, instructions, and regulatory compliance information. The label is also aesthetically pleasing to the consumer, which enhances shelf appeal and increases consumer interest in the product.

In addition to the three separate plies which make-up the multi-ply composite container, to withstand the rigors of shipping the food product and internal pressure sometimes produced within the containers, such composite containers typically also include metallic or plastic end closures configured to engage an end portion of the paperboard body ply. The metal or plastic ends serve to provide rigidity to the composite containers while retaining the food product.

A critical factor in composite container design is the ease with which such containers may be opened. These containers are often designed to incorporate different opening features. Where the food product is potato crisps, for example, the composite container is typically designed with a metal closure at one of its ends, and a removable foil seal or membrane with a plastic overcap at the other. In this way, the container is easily reclosed after the foil seal is broken. Thus, left over food product can be easily stored in the reclosable container.

One common problem associated with composite container product packaging is that the volume of the composite container is fixed, while the volume of the food product within the container diminishes as the food product is consumed. Thus, when tall, narrow tubular food product containers are used to package snacks or other consumable products such as potato crisps, the consumer often is unable to reach the food product near the bottom of the container. Such containers are too small in diameter to allow an entire hand to reach into the container, and too tall to allow the fingers alone to reach the food product near the container bottom.

U.S. patent application Ser. No. 09/561,662 for a "Multi-Ply Composite Container With Region Of Weakened Strength And Method For Manufacturing Same" filed concurrently herewith, and which is incorporated herein by reference, proposes a multi-ply composite container that solves the problem of the consumer being unable to reach the food near the bottom of the container as the food is consumed. In particular, the multi-ply composite container of the above-referenced application utilizes scores lines to create regions of weakened strength in the composite container and thereby advantageously permit the composite container to be reduced, or broken, into discreet sections. As the volume of the food product within the composite container is reduced through consumption, therefore, the size of the composite container can be reduced, or broken apart, by hand, section by section, to conform to the volume reduction of the food product. The composite container of the above-referenced application is therefore reducible so that its size will continuously compliment and accommodate the volume of food product in the container. One of the resulting features of the reduced container is that the outer diameter of the mouth of the reduced container is smaller than the outer diameter of the mouth of the container before it is reduced.

It would be desirable to provide an overcap for an adjustable volume container that is versatile enough to compliment the adjustable volume characteristics of such a container. In particular, it would be desirable to have a multi-functional end closure that compliments the adjustable volume characteristics of the container such that the container/overcap assembly would be self-contained and continuously accommodate the volume of the food product in the container.

SUMMARY OF THE INVENTION

These and other objects and advantages are provided, according to the present invention, by a reversible overcap for an adjustable volume container for consumer products. The reversible overcap includes a first side adapted for engaging a retaining rim formed in one end of the container and a second side adapted for engaging an exposed end of a remaining portion of the container. The exposed end of the container is formed by separating a portion of the container from the remaining portion of the container.

The first side of the reversible overcap includes a radially extending surface and an annular rim extending outwardly from the radially extending surface for engaging the retaining rim of the container. In one embodiment, the annular rim extends perpendicularly from the radially extending surface of the reversible overcap.

The second side of the reversible overcap includes an annular member that is adapted to frictionally engage the exposed end of the remaining portion of the container. In one embodiment, the member is a channel having a U-shape.

Consequently, the overcap of the present invention is versatile enough to compliment the adjustable volume characteristics of adjustable volume composite containers such as the container disclosed in the above application. In particular, the overcap of the present invention is designed to accommodate both the diameter of the mouth of the unreduced container and the diameter of the mouth of the reduced volume container. The overcap of the present invention is thus, advantageously, a multi-functional end closure that is part of a completely self-contained adjustable volume container for consumer products that continuously accommodates the volume of the food product in the container.

BRIEF DESCRIPTION OF THE DRAWINGS

Some of the objects and advantages of the invention have been set forth, and other objects and advantages of the invention will become apparent in the detailed description of the preferred embodiments of the invention to follow, especially when taken in conjunction with the accompanying drawings, which are not necessarily drawn to scale, wherein.

DETAILED DESCRIPTION OF THE INVENTION

The present invention will now be described more fully with reference to the accompanying drawings, in which preferred embodiments of the invention are shown. The invention may, however, be embodied in many different forms and should not be construed as limited to the embodiments set forth herein; rather, these embodiments are provided so that this disclosure will be thorough and complete and will fully convey the scope of the invention to those skilled in the art. Like numbers refer to like elements throughout.

Figure 1:
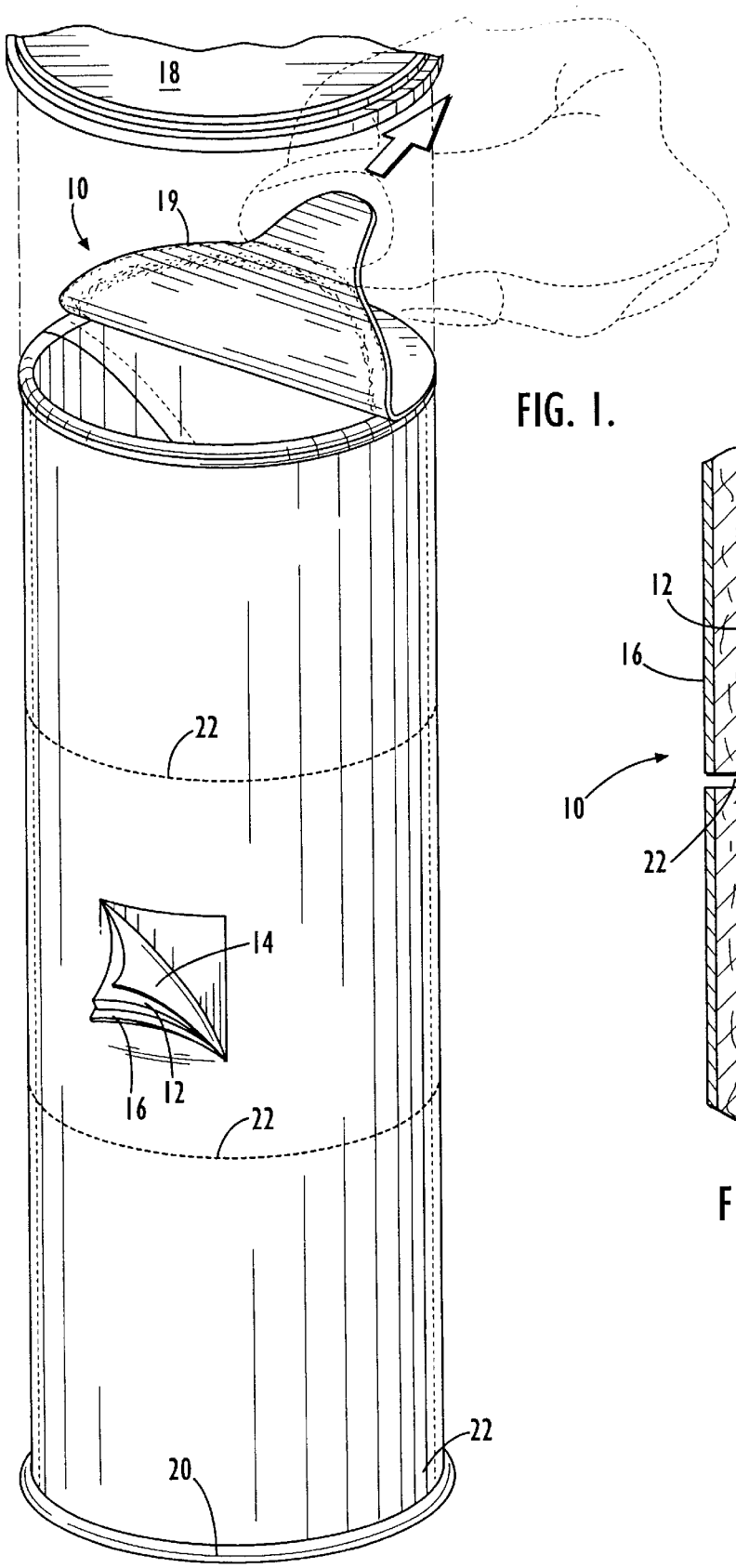
FIG. 1 is a perspective view of an adjustable volume container for consumer products.

FIG. 1 illustrates an adjustable volume container 10 for consumer products. Although illustrated as having a circular cross section, the container may have any cross sectional shape which can be formed by wrapping multiple plies of material around an appropriately shaped mandrel. One example is a generally rectangular shape having rounded corners.

The embodiment illustrated is particularly advantageous for packaging potato crisps and, as shown in FIG. 1, includes a tubular body ply 12 formed of paperboard material, a liner ply 14 adhered the inner surface of the tubular body ply 12, and a label ply 16 adhered to the outer surface of the tubular body ply 12. The adjustable volume container 10 also includes an overcap 18, a flexible seal 19 or membrane and a plastic or metal end closure 20. Various types of end closures may be used, depending upon the type of food product which is to be packaged.

Figure 3:
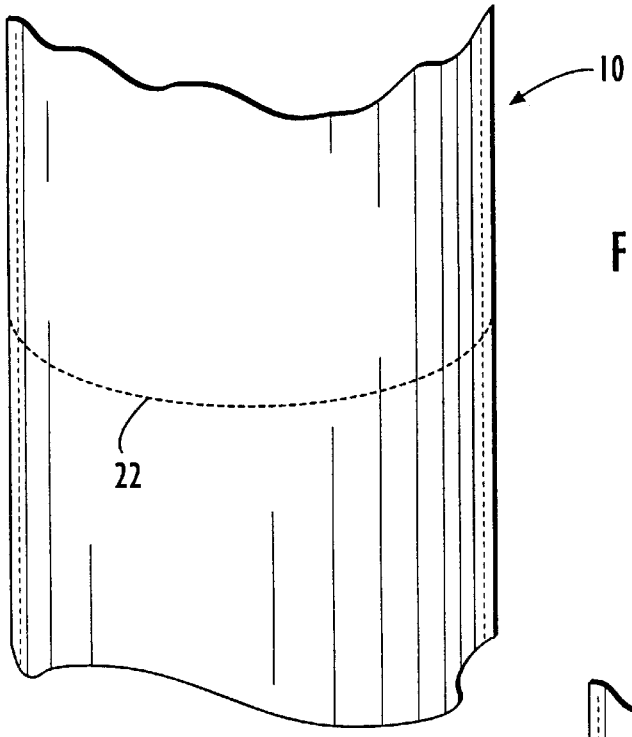
FIG. 3 is an enlarged perspective view of the adjustable volume container of FIG. 1 specifically demonstrating a circumferential score line of perforations in the container.
Figure 4:
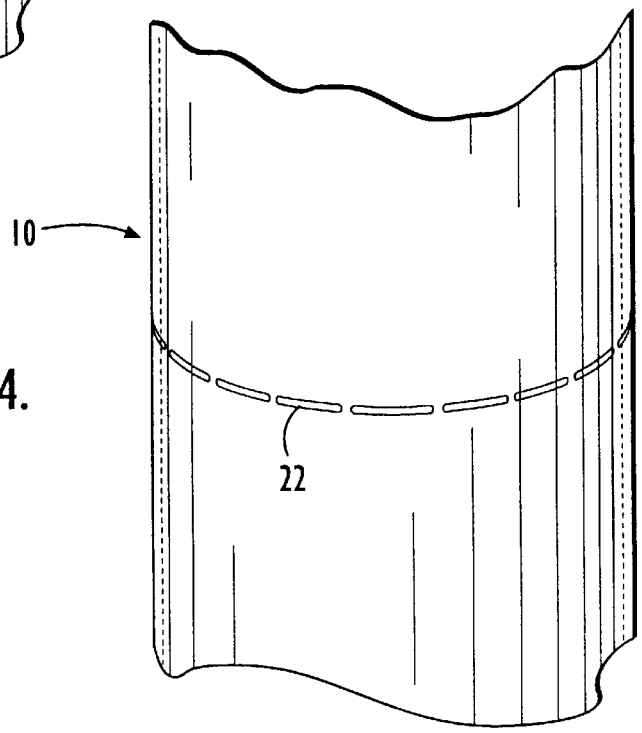
FIG. 4 is an enlarged perspective view of the adjustable volume container of FIG. 1 specifically demonstrating a circumferential score line of discontinuous grooves in the container.

The adjustable volume container 10 also includes a number of score lines 22 extending circumferentially about the container 10. The score lines 22 may extend only partially about the circumference of the container 10 or may extend completely about the circumference of the container 10. As illustrated in more detail in FIG. 2, the score lines 22 are cut into the label ply 16 and through the body ply 12, but not into the liner ply 14 of the container 10. The score lines 22 may either be perforated score lines or a series of discontinuous grooves as demonstrated in FIGS. 3 and 4, respectively.

Figure 2:
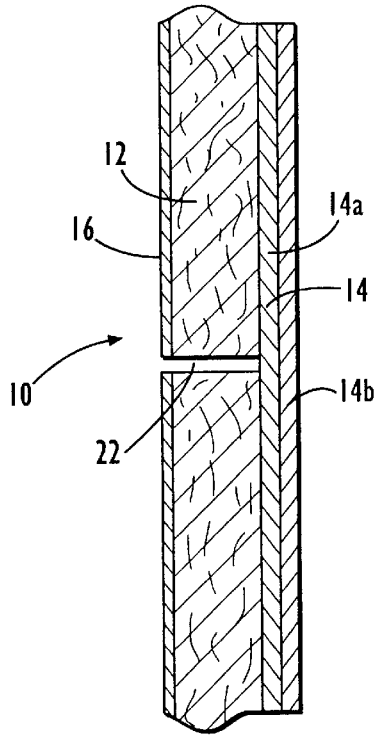
FIG. 2 is a section view of the wall of the adjustable volume container of FIG. 1.

The liner ply 14 can include one or more layers as shown in FIG. 2. In particular, conventional liner plies often comprise several layers including a barrier layer to prevent the passage of moisture and gasses into and out of the container. One type of liner ply includes a foil barrier layer 14*a* and an overlying polymer layer 14*b*. Another type comprises layers which are made of polymeric materials.

Figure 5:
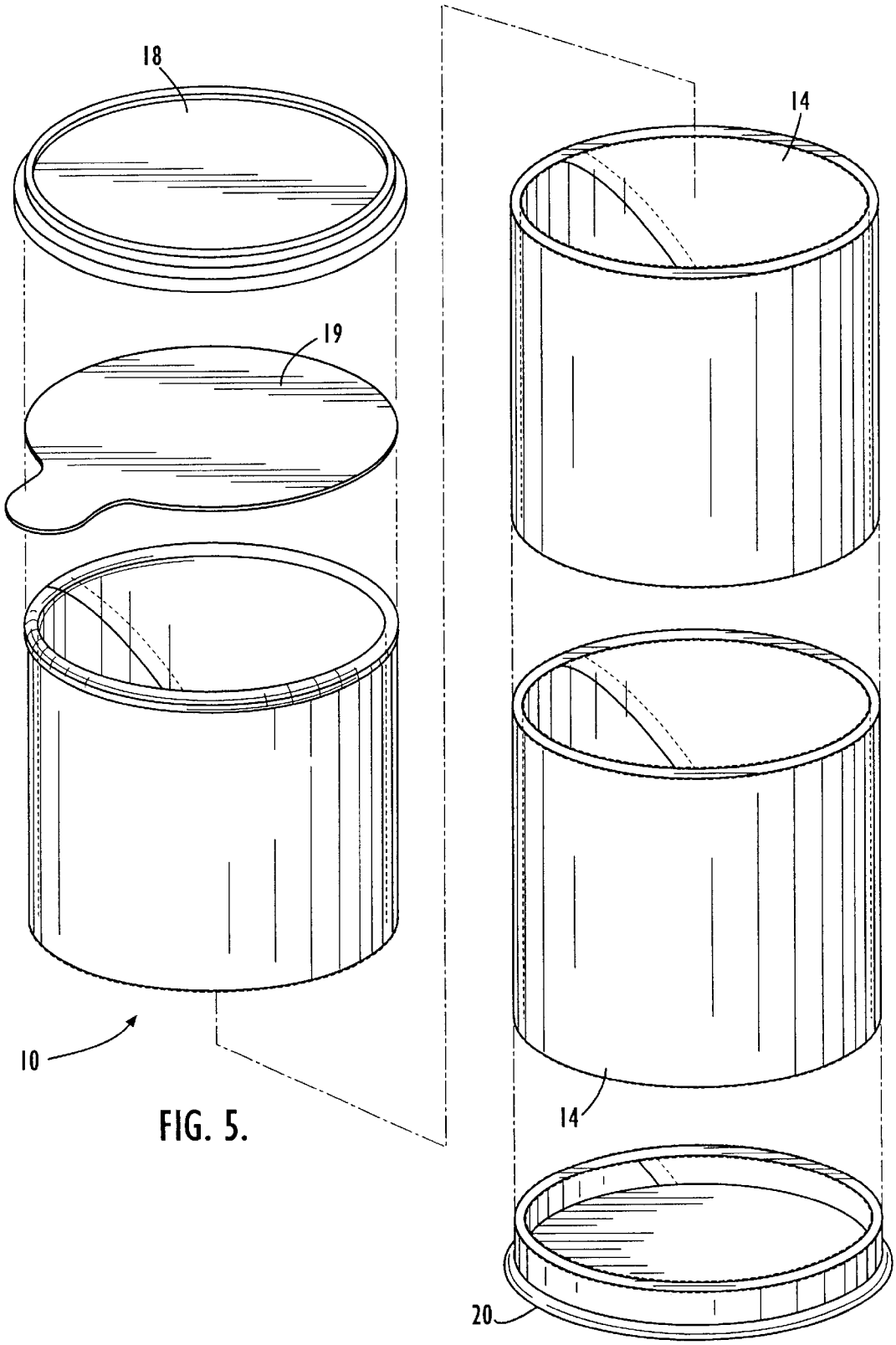
FIG. 5 is an exploded perspective view of the adjustable volume container of FIG. 1.

As demonstrated in FIG. 5, the score lines 22 advantageously create regions of weakened strength in the composite container 10 and thereby permit the adjustable volume container 10 to be reduced, or broken, into discrete sections. As the volume of the food product within the container 10 is reduced through consumption, therefore, the size of the container 10 can be reduced or broken apart by hand, section by section, to conform to the volume reduction of the food product.

Figure 6:
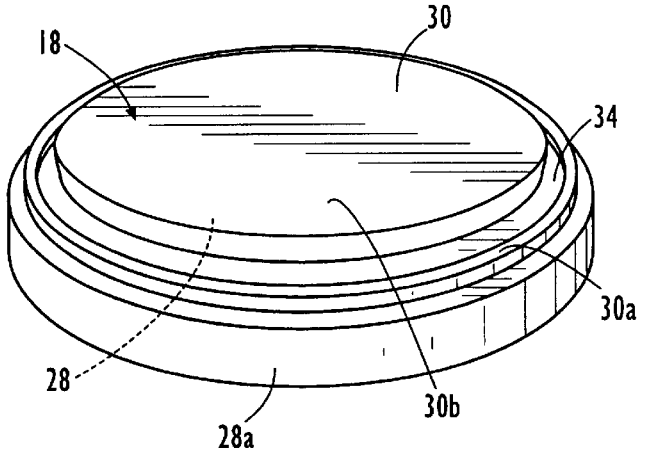
FIG. 6 is an enlarged perspective view of the reversible overcap of the present invention.
Figure 7:
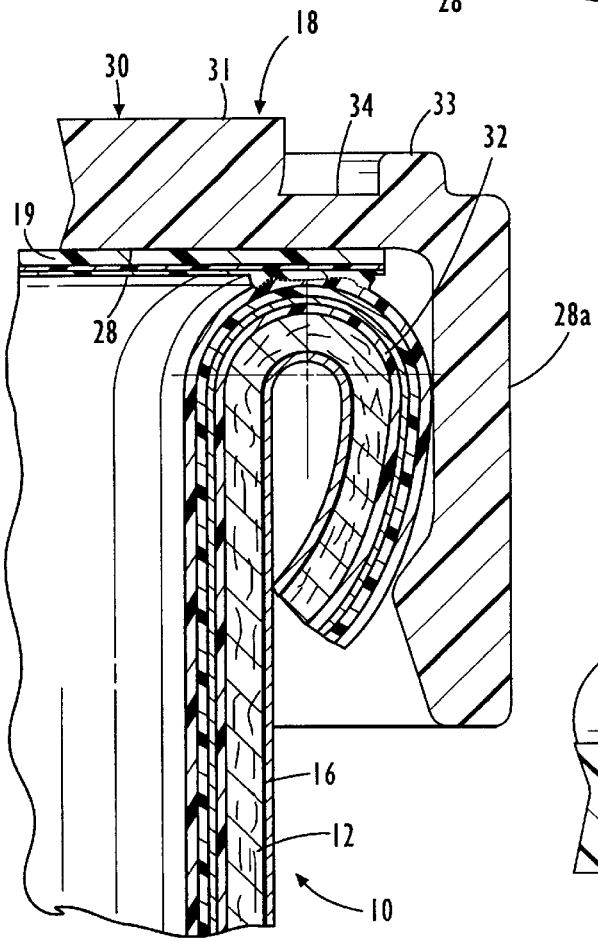
FIG. 7 is an enlarged section view of a first side of the reversible overcap engaging the container.
Figure 8:
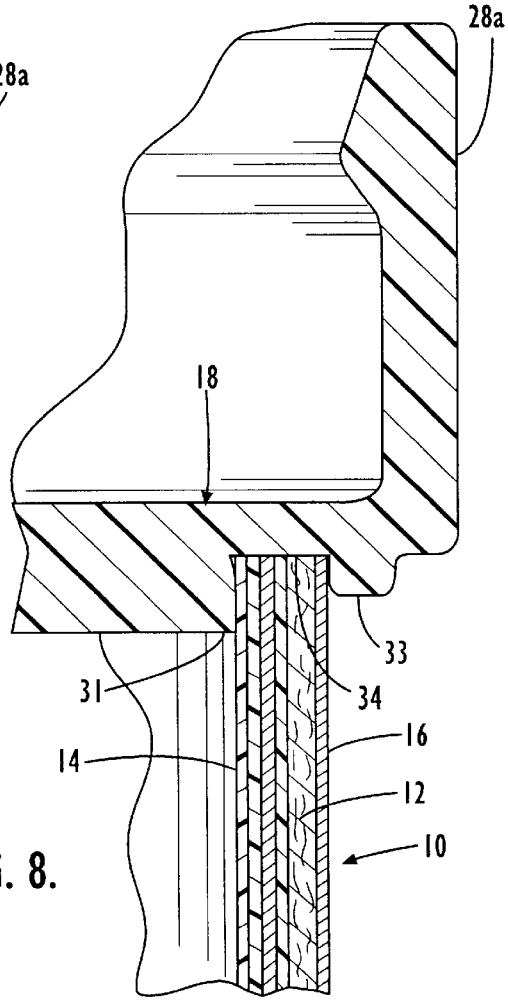
FIG. 8 is an enlarged section view of a second side of the reversible overcap engaging the periphery of a remaining portion of the container.

As shown in FIGS. 6 through 8, the reversible overcap 18 is designed so that a first side 28 of the overcap 18 engages the top of the container 10 and a second side 30 of the overcap 18 engages the periphery of each of the remaining sections of the container 10. As described above, the remaining sections are formed by breaking the container 10 apart at the circumferential score lines 22. As shown in FIGS. 6 and 7, the first side 28 of the overcap 18 advantageously has an annular rim 28*a* for engaging a retaining rim 32, such as a bead or flange, formed in the end of the container 10. Thus, FIG. 7 demonstrates how the overcap 18 fits snugly over the flexible seal 19 and the container 10 by virtue of the engagement of the annular rim 28*a* with the retaining rim 32. The overcap 18 likewise snugly fits over the container 10 after removal of the flexible seal 19.

The second side 30 of the overcap 18 has an annular member 31, which together with an annular rim 33, forms a channel 34. As shown in FIG. 8, the annular member 31 is sized and shaped to frictionally engage the exposed end of the remaining section of the container 10 as the container 10 is reduced in volume or broken apart by virtue of the score lines 22. Thus, when the container 10 is broken apart, the overcap 18 can be inverted to plug each of the remaining sections of the container 10. In one embodiment, the profile of the channel 34 that is formed by virtue of the annular rim 33 is U-shaped.

Therefore, each section of the container 10 and the reversible overcap 18 combine to form discrete containers for left over food product.

Advantageously, therefore, although the composite container 10 may begin as a tall, narrow tubular container to accommodate the volume of food product, the size of the container reduces with the volume of food product.

Additionally, the overcap 18 originally fits snugly over the retaining rim 32 of the container 10. As the volume of food product in the container diminishes, however, the size of the container 10 may be reduced by breaking the container 10 apart at the score lines 22. In this arrangement, the overcap 18 may be inverted or reversed to plug the periphery of each of the remaining sections of the container 10.

Thus, the composite container 10 solves the problem of the consumer being unable to reach the food near the bottom of the container as the food is consumed. The container is no longer too small in diameter to allow an adult hand to reach into the container or too tall to allow the fingers alone to reach the food near the container bottom. Moreover, the overcap 18 of the present invention is versatile enough to compliment the adjustable volume characteristics of the adjustable volume container 10. The overcap of the present invention is thus a multi-functional end closure that is part of a completely self-contained adjustable volume container that continuously accommodates the volume of the food product in the container.

That which is claimed:

1. An adjustable volume container for consumer products, comprising:

a tubular container having a cylindrical body wall defining inner and outer surfaces and opposed ends, at least one of said opposed ends having a retaining rim extending radially outward of said outer surface;

at least one circumferential score line extending about at least part of the circumference of said tubular container for permitting a portion of said tubular container including said retaining rim to be separated from the remaining portion of said tubular container, thereby creating an exposed end of the remaining cylindrical body wall of said tubular container; and a reversible overcap having first and second opposed sides, said first side adapted for engaging said retaining rim and said second side having radially spaced apart surfaces structured and arranged to receive and frictionally grip therebetween said exposed end of the remaining cylindrical body wall of said tubular container.

2. An adjustable volume container as defined in claim 1, said first side of said reversible overcap comprising:

a radially extending portion; and an annular rim extending axially from said radially extending portion for engaging said retaining rim of said tubular container.

3. An adjustable volume container as defined in claim 2 wherein said annular rim extends perpendicularly from said radially extending portion.

4. An adjustable volume container as defined in claim 1, wherein the radially spaced apart surfaces on said second side of said reversible overcap comprise a pair of concentric cylindrical surfaces defining a channel therebetween for frictionally engaging said exposed end of the remaining portion of said tubular container.

5. An adjustable volume container as defined in claim 1 wherein the outer diameter of said first side of said overcap is greater than the outer diameter of said second side of said overcap.

6. An adjustable volume container as defined in claim 1, further comprising a tear away membrane sealed over said retaining rim of said tubular container.

* * * * *